United States Patent [19]

Sterling

[11] Patent Number: 4,991,533

[45] Date of Patent: Feb. 12, 1991

[54] BOAT BOTTOM CLEANING DEVICE

[76] Inventor: Charles Sterling, 457 Lake Havasu Dr., Virginia Beach, Va. 23454

[21] Appl. No.: 230,298

[22] Filed: Sep. 16, 1988

[51] Int. Cl.[5] ..... B63B 59/08

[52] U.S. Cl. ..... 114/222; 15/144 R

[58] Field of Search ..... 114/222; 15/144 R, 144 A

[56] References Cited

U.S. PATENT DOCUMENTS

| | | | |
|---|---|---|---|
| 1,416,081 | 6/1920 | White | 15/144 R |
| 3,010,420 | 11/1961 | Glynn | 114/222 |
| 4,060,047 | 11/1977 | Sabella | 114/222 |
| 4,407,213 | 10/1983 | Evans | 114/222 |

FOREIGN PATENT DOCUMENTS

| | | | |
|---|---|---|---|
| 30025 | 8/1922 | Denmark | 114/222 |
| 2465568 | 4/1981 | France | 114/222 |
| 625974 | 9/1961 | Italy | 15/144 R |
| 648144 | 11/1962 | Italy | 15/144 R |
| 10021 | 8/1923 | Netherlands | 114/222 |
| 2142525 | 1/1985 | United Kingdom | 114/222 |

*Primary Examiner*—Joseph F. Peters, Jr.
*Assistant Examiner*—Thomas J. Brahan

[57] ABSTRACT

A boat brush is disclosed for cleaning the submerged portion of the hull. The brush has a high degree of structural strength, adequate clearance during operation as no part of the brush frame will make unwanted contact with the hull, and the brush contacts all of the hull with a two position locking brush head.

3 Claims, 3 Drawing Sheets

BOAT BOTTOM CLEANING DEVICE

INTRODUCTION

Figure 1:
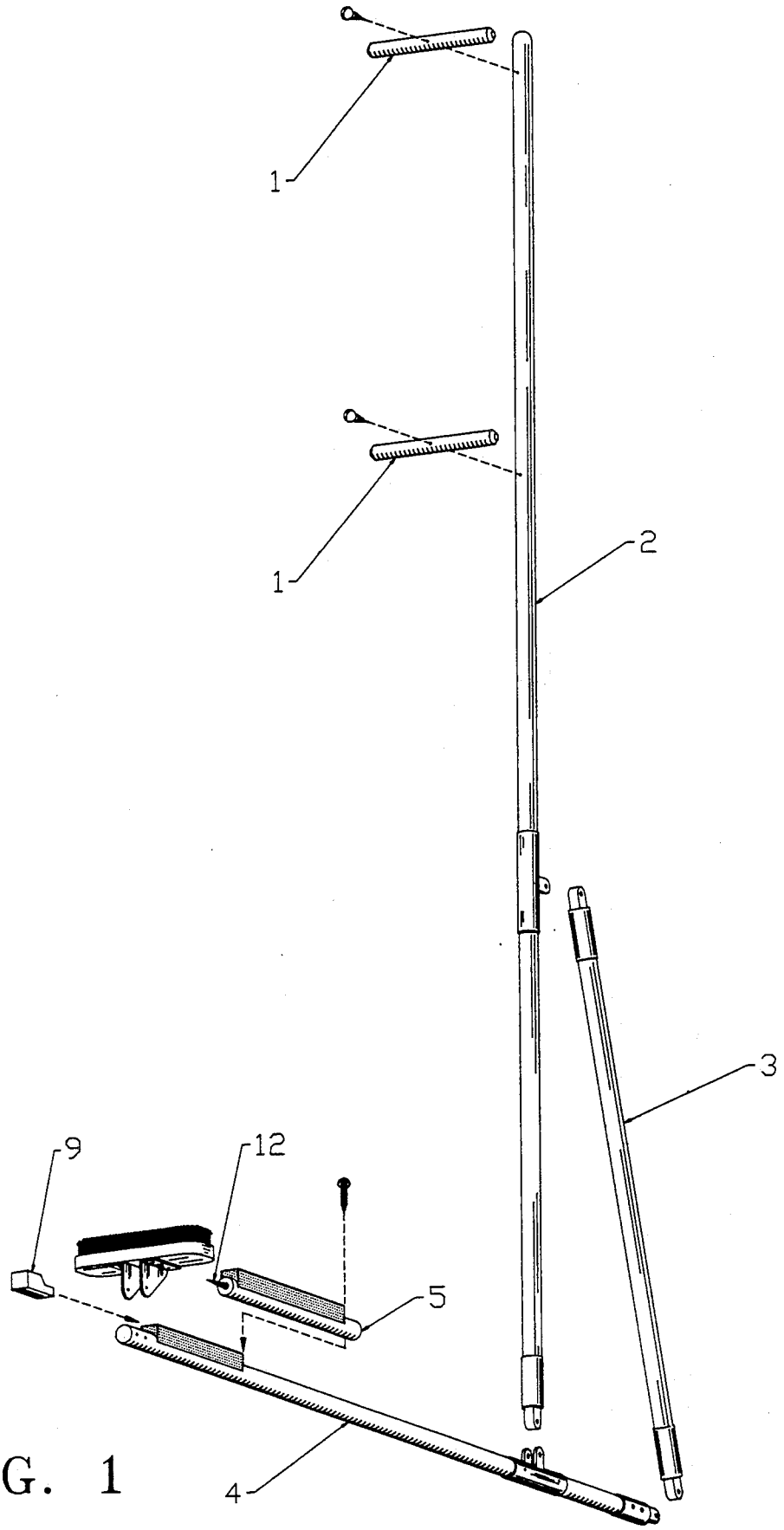

This invention enables a person to clean the inwardly variable contoured boat bottom while aboard the boat. This device is low in cost, simple, and employs a structural design which allows substantial physical force to remove accumulated marine slime and algae.

BACKGROUND

After purchasing a twenty three (23) foot sailboat in October 1987, I was concerned about below water line maintenance of the hull, fin keel, rudder skeg, and rudder, prior to commissioning the boat, the below water line areas were painted with an Environmental Protection Agency approved anti-fouling boat bottom paint. After which the boat was placed in the water and secured in its slip. After three (3) or four (4) weeks a noticeable color change (darker) started covering the bottom paint. This was marine slime and algae accumulation. In spite of numerous boat outings this accumulation persisted. I consulted with a number of marina operators, sailboat owners, marine equipment store sales people, and catalogues. It was revealed that this accumulation is a normal occurrence when a boat remains in the water. And, the only means for cleaning a boat bottom is to, (1) get into the water and scrub, (2) hire a diver to get into the water and scrub, (3) dry dock/haul out, (4) scrub from a raft alongside. All of the aforementioned was unacceptable to me due to, (1) time factor, (2) expense, (3) discomfort. Clinging marine slime and algae adversely effects boat performance by creating excessive hull to water friction. And is especially noticeable in a sailboat as the wind is its source of power.

Due to my need for a cleaning device which is commercially unavailable for this purpose, I invented this boat bottom cleaning device. Since October 1987 to the present time, I have used this original and only known device of its kind for my own personnel use to my complete satisfaction. My boat is in a slip located in the Long Creek Navigational Channel in Virginia Beach, Va. During numerous instances while operating my invention, many boaters passing slowly by in this channel voiced positive comments, including suggestions that I should apply for a patent. I am also encouraged by friends, family members, and individuals walking by and taking the time to observe my boat bottom cleaning process.

I engaged the services of a patent attorney to perform a "search" to determine if an invention resembling mine is actively patented. Please refer to attorneys report of July 5, 1988. Findings relative to the four (4) patents for boat bottom cleaning devices reveal that the unique shape of my design comprising an obtuse geometric form provides, (1) a high degree of structural strength, (2) adequate clearance during operation as no part of the device frame will make unwanted contact with the boat hull inward variable contour, (3) the bristles to contact all under water areas with the two (2) position (90 degrees and horizontal) positive locking brush head while the user is positioned on or within a boat, (4) a high degree of leverage by means of coordinated body arching and vertical movements.

The four (4) following patents were uncovered in a search for related patents concerning this patent application.

U.S. Ser. No. 637,702
U.S. Pat. No. 3,010,420
U.S. Pat. No. 4,060,047
U.S. Pat. No. 4,407,213

SUMMARY

This invention provides a practical and inexpensive method for boaters to periodically (i.e. weekly, biweekly, monthly etc.) clean a boat bottom which can preclude the customary annual dry dock/haul out expense for cleaning and repainting. Because the original anti-fouling paint will remain intact for a longer duration with continual optimum performance and greater utilization potential of the boat.

BRIEF DESCRIPTION OF DRAWING FIG. 1

Figure 2:
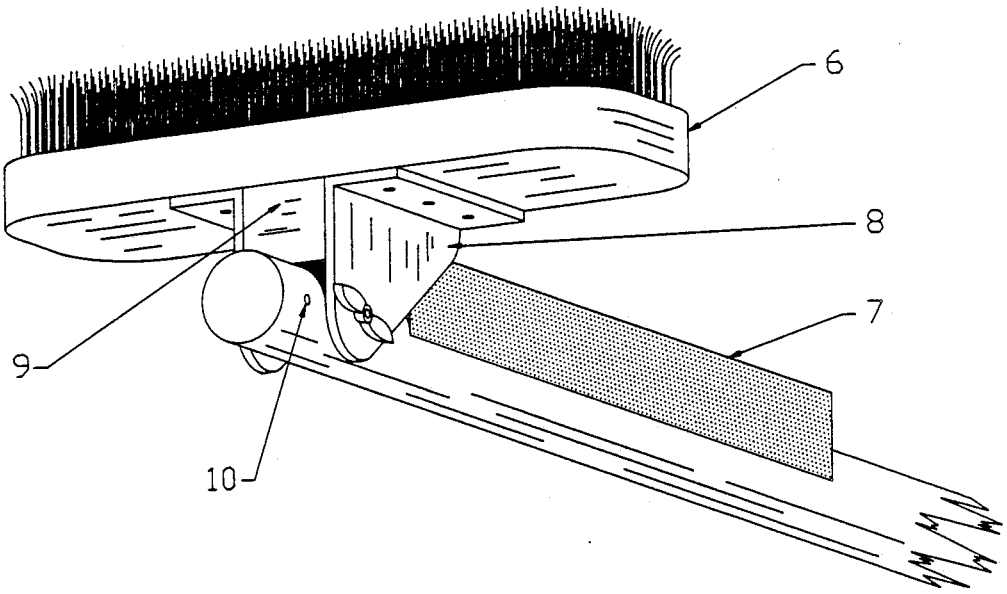
Figure 3:
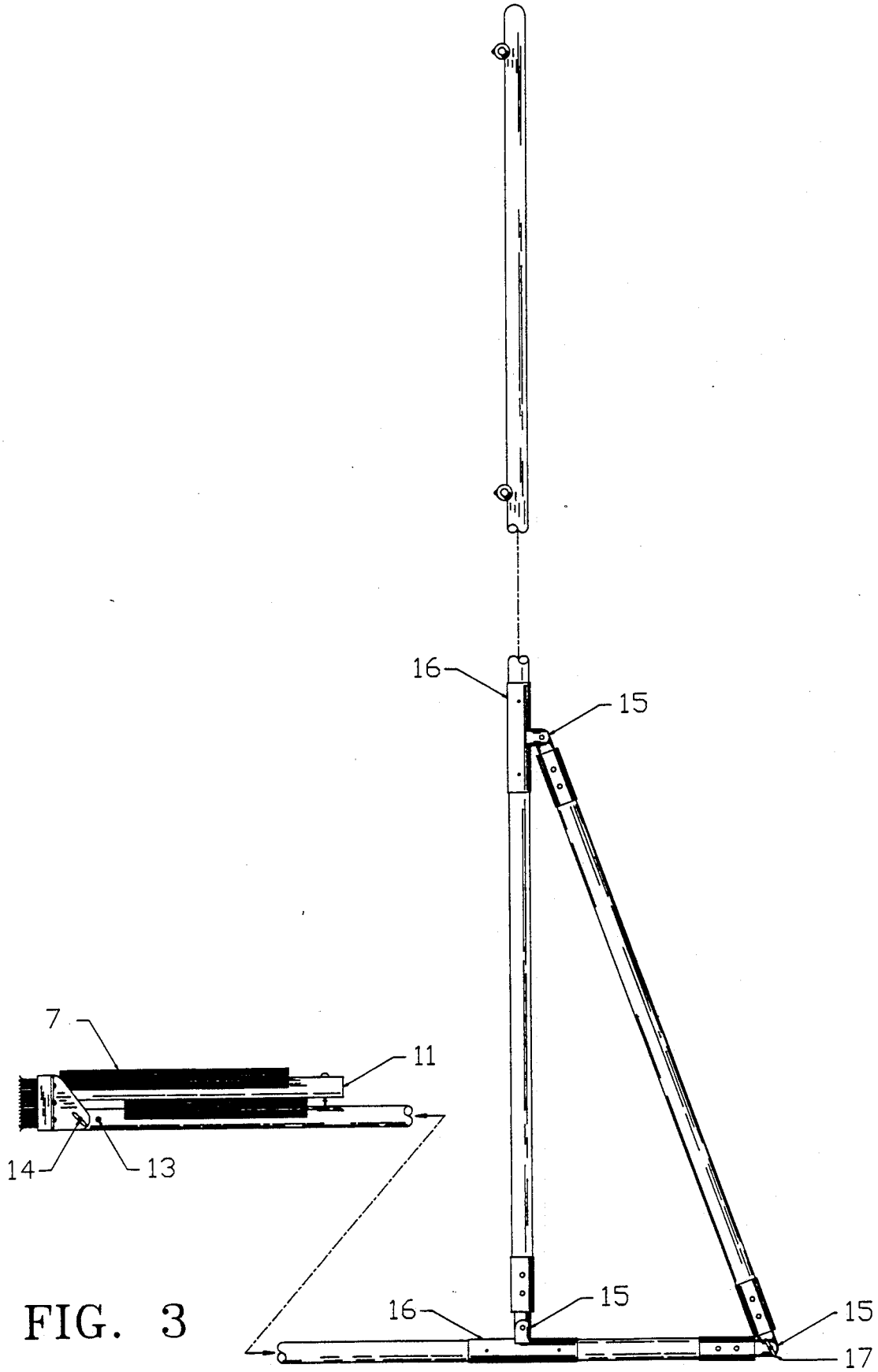

FIG. 1, exploded view of cleaning device.
FIG. 2, brush mounted at 90 degree position.
FIG. 3, shows brush mounted in horizontal position.
FIGS. 4 thru 7 shows the brush being used to clean a boat hull.

1—Upper and lower twist handles to assure brush head end to end flush bristle contact with boat bottom surfaces (wood for buoyancy).
2—Vertical pole (wood for buoyancy).
3—Angle support pole (wood for buoyancy).
4—Horizontal pole (wood for buoyancy).
5—Brush head horizontal support pole (wood for buoyancy).
6—Brush head, most any buoyant brush (approximately 9"×3") can be used which has stiff bristles.
7—Bumper strip, to protect bottom of fin keel, rudder, and rudder skeg.
8—Brush head support brackets (aluminum)
9—Brush head 90 degree angle locking block in position (snug fit).
10—Brush head horizontal position hole.
11—Brush head horizontal position support pole (5) shown installed and secured.
12—Screw engages brush head threaded receptacle.
13—Brush head 90 degree angle position hole.
14—Screw with wing nut to facilitate brush head repositioning.
15—Eyebolt/clevis arrangement (typical 3 places) secured with bolt and nut (not shown) at the two pole reinforcement locations.
16—Aluminum sleeve reinforcement (around pole) at two (2) high stress areas.
17—Screw with wing nut to facilitate device folding for storage.

I claim that:

1. A device for cleaning the bottom of a boat while the boat is afloat, manually by an operator standing on the boat, the device comprising:

a. a vertical pole member;
b. a horizontal pole member;
c. a brush means mounted at one end of said horizontal pole member as to be mounted in two positions, a horizontal position which has the brush means extending along the longitudinal axis of the horizontal pole member, and a 90 degree position which has the brush means extending laterally from said horizontal pole member;

d. a first sleeve reinforcement mounted on said horizontal pole member and connected to one end of said vertical pole member;

e. an angle support member;

f. a second sleeve reinforcement mounted intermediately on said vertical pole member; and g. said angle support member connected at one end to said second sleeve reinforcement and at the other end to the other end of said horizontal pole member, as to have the angle support member brace the cleaning device without contacting the boat.

2. The device for cleaning the bottom of a boat as recited in claim 1 further comprising a support horizontal pole member mounted to the brush means and mounted to the horizontal pole member for reinforceing the connection between the brush and horizontal member securing the brush in the horizontal position.

3. The device for cleaning the bottom of a boat as recited in claim 1 further comprising a block means for securing the brush in the 90 degree position.

* * * * *